US006276353B1

(12) United States Patent
Briggs et al.

(10) Patent No.: US 6,276,353 B1
(45) **Date of Patent: *Aug. 21, 2001**

(54) PROJECTILE LAUNCHER

(75) Inventors: Rick A. Briggs, Springfield, IL (US); Edward James Frantz, III, Nehalem, OR (US)

(73) Assignee: Koala Corporation, Denver, CO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/920,000

(22) Filed: Aug. 28, 1997

Related U.S. Application Data

(60) Provisional application No. 60/037,423, filed on Feb. 21, 1997.

(51) Int. Cl.[7] ..... F41B 11/00

(52) U.S. Cl. ..... 124/71; 124/72; 124/73; 124/77

(58) Field of Search ..... 124/56, 69, 70, 124/77, 71, 72, 73

(56) References Cited

U.S. PATENT DOCUMENTS 3,400,703 * 9/1968 Rhodes ..... 124/77
3,802,705 * 4/1974 Baras et al. ..... 124/77
3,851,880 * 12/1974 Ritch ..... 273/128 R
5,450,838 * 9/1995 Nakahigashi et al. ..... 124/56
5,507,271 * 4/1996 Actor ..... 124/56
5,515,837 * 5/1996 Nin et al. ..... 124/59
5,967,916 * 10/1999 Robeson ..... 473/600

OTHER PUBLICATIONS

McMaster–Carr, p. 1554, circa 1996–1997, *Ejector Exhaust Mufflers*.

* cited by examiner

*Primary Examiner*—J. Woodrow Eldred
(74) *Attorney, Agent, or Firm*—David P. Wood; Snell & Wilmer, LLP

(57) ABSTRACT

A projectile launcher is provided for propelling impact-safe foam projectiles. The projectile launcher includes a launch tube sized and configured to accommodate insertion of an impact-safe projectile with substantially little or no friction between the launch tube inner wall and the projectile. A nozzle is disposed adjacent one end of the launch tube. The nozzle is adapted to receive a flow of compressed air from a source and to discharge a stream of high-velocity air which impinges upon the projectile disposed within the launch tube. A play-participant-actuated valve is interposed between the nozzle and the source of compressed air to control the flow of air to the nozzle. The valve is adapted, when actuated, to place the nozzle in communication with the source of compressed air. Upon actuation of the valve the nozzle discharges a stream of high-velocity air which transfers momentum to the projectile, propelling it down the launch tube and into the air or at a selected target.

42 Claims, 10 Drawing Sheets

PROJECTILE LAUNCHER

This Application claims the benefit of Provisional No. 60/037,423 filed Feb. 21, 1997.

BACKGROUND OF THE INVENTION

1. Field of the Invention

The present invention relates generally to children's participatory play devices, and, in particular, to an impact-safe projectile launcher for propelling foam or other projectiles using pressurized and/or high-velocity air.

2. Description of the Related Art

Over the past decade there has been a steady proliferation of commercial play structures designed to meet the recreational needs of young families. These play structures are typically adapted for either water play and/or non-water play use, as desired, and can provide a safe and exciting alternative to more traditional parks and playgrounds. Participatory play structures, that is, play structures that allow play participants to actively participate in creating desired effects, are particularly desirable because of their widely recognized entertainment and educational benefits.

The size and sophistication of modem participatory play structures has grown tremendously as the basic concepts of participatory play have been successfully expanded and adapted to a wide variety of fun and exciting play mediums and play themes. These play structures allow a great variety of stimulating and entertaining play activities for children and young adults. Such participatory play structures have found broad application to a variety of play media and participatory play activities incorporating a wide range of fun and exciting play effects, mechanisms, springs, cams, pulleys, gears, and the like, all of which are employed to provide a play experience which is both fun and, at the same time, educational. See, for example, my co-pending application U.S. Ser. No. 08/621,173, incorporated herein by reference.

One especially exciting and entertaining participatory play activity, particularly for play structures utilizing water as the primary play medium, involves shooting a stream of water at selected targets and/or other play participants. This usually entails some form of a water cannon, water gun, squirt gun, spray hose or the like, which play participants can operate to surprise other play participants or to achieve desired effects. Such participatory play activities provide particular benefits in developing children's motor skills and hand-eye coordination. It also provides endless fun for play participants, who enjoy the challenge of trying to hit various targets and/or one another.

It would be desirable to replicate this play activity for participatory play structures utilizing dry play mediums, such as foam balls or the like. However, unlike a stream of water, which assumes a relatively streamlined aerodynamic shape during flight and which disperses harmlessly on impact, dry participatory play media typically involves the use of discrete articles having a defined size, shape and mass, which remain constant during flight and upon impact. Moreover, while water is easily regulated at the source to ensure that the pressure and impact velocity of the resulting stream remains within predetermined safe parameters, the impact velocity of discrete projectiles is not so easily regulated. Thus, while it is possible to project an impactsafe stream of water over relatively large distances of 20 to 30 feet with fairly good accuracy, the same task becomes considerably more difficult when using discrete projectiles such as foam balls.

Various guns or projectile launchers have been proposed over the years for the general purpose of launching projectiles. U.S. Pat. No. 5,343,849 to Steer, for example, describes a variety of air-powered guns heretofore available. These air-powered guns typically have barrels and gun bodies made of lightweight plastic and are designed to be portable for carrying around during simulated "war games." As disclosed, for example, in U.S. Pat. No. 5,113,842 to Moormann, such air guns typically utilize a plunger or bladder to pump or compress air within the gun stock in order to build sufficient pressure to discharge a projectile such as a ping-pong ball or soft foam ball. However, due to the relative small size of these air guns and their limited capacity for safely containing a charge of compressed air, the projectiles generally do not travel great distances and the guns are not particularly accurate. Most of these guns are inexpensive toys available from retail toy stores and, therefore, they are not intended to be particularly durable. They would not, for instance, be able to withstand repeated or long-term heavy use and abuse by multiple play participants playing on, in or around a participatory play structure.

Longer range, more accurate air guns are also known which fire pellets or BBs using a compressed source of $CO_2$ or other compressed gas. These typically resemble handguns or rifles and are not intended for use by children without adult supervision or for use by small children. The BBs are usually steel or copper balls about 0.175" in diameter. Due to their small size and high velocity, BBs can be very painful and even dangerous if they impact a human target, especially at close range. Thus, these types of air guns are not at all well suited for use in a participatory play environment in which children and young adults may be exposed to possible danger.

Other types of ball or projectile launchers include baseball pitching machines and tennis ball throwing machines. These generally use a mechanical arm or a sleeve of compressed air to propel a series of balls in a predetermined or preset trajectory. The users are typically the recipients of the balls and do not directly control the delivery of the balls from the machine or their trajectory. Thus, these types of machines are primarily used for hitting practice in softball, baseball and/or tennis. They would not typically be used, for example, for propelling balls at targets or at other persons. Accordingly, such projectile launchers would not be suited for use in a participatory play environment where the balls could strike and possibly cause injury to play participants.

SUMMARY OF THE INVENTION

An object of the present invention, therefore, is to provide a participatory foam projectile launcher, specifically adapted for safe use by play participants playing in, on or around a participatory play structure, for propelling impact-safe foam projectiles (or other impact-safe projectiles) over distances of about 20 to 30 feet or more with relatively good accuracy. Another object of the present invention is to provide an air-powered projectile launcher that is durable and safe for use by small children.

As used herein, the term "air" shall include any substance or combination of substances having the general compressibility and flow characteristics of a gas, including, without limitation, air, $CO_2$, aerated foam or bubbles, and/or steam. The term "foam" shall include any substance or combination of substances having the general resiliency and/or impact absorbing characteristics of an expanded foam material, including, without limitation, expanded polyurethane, expanded EVA foam, foam rubber, soft rubber, styrofoam, air-filled balls or other articles, bean bags or stuffed articles, and the like.

In accordance with one embodiment the present invention provides a projectile launcher and method for propelling impact-safe projectiles. The projectile launcher includes a launch tube sized and configured to accommodate insertion of an impact-safe projectile with substantially little or no friction between the launch tube inner wall and the projectile. A nozzle is disposed adjacent one end of the launch tube. The nozzle is adapted to receive a flow of compressed air from a source and to discharge a stream of high-velocity air so as to impinge upon the projectile disposed within the launch tube. A play-participant-actuated valve is interposed between the nozzle and the source of compressed air to control the flow of air to the nozzle. The valve is adapted, when actuated, to place the nozzle in communication with the source of compressed air. Upon actuation of the valve the nozzle discharges a stream of high-velocity air which transfers momentum to the projectile, propelling it down the launch tube and into the air or at a selected target.

In accordance with another embodiment the present invention provides a projectile launcher and method for expelling impact-safe projectiles using compressed air. The projectile launcher includes a launch tube substantially sealed at one end and being sized and configured to accommodate insertion of an impact-safe projectile. An air reservoir is provided for containing a charge of compressed air. A nozzle is disposed adjacent the sealed end of the launch tube and is adapted to receive the compressed air from the reservoir and deliver it into the launch tube between the projectile and the sealed end of the launch tube. A valve is interposed between the nozzle and the air reservoir, which can be actuated by a play participant to place the nozzle in communication with the compressed air in the air reservoir. Upon actuation of the valve, the nozzle delivers the charge of compressed air into the launch tube, expelling the projectile from the launch tube and into the air or at a selected target.

In accordance with another embodiment the present invention provides a participatory projectile launcher including a housing and a launch tube sized and configured to accommodate insertion of an impact-safe projectile. An air reservoir is disposed on or within the housing for containing a charge of compressed air. A play-participant-operated pump is provided to enable play participants to pump a charge of compressed air into the air reservoir. A valve is interposed between the air reservoir and the launch tube and is adapted, when actuated, to place one end of the launch tube in communication with the compressed air contained within the air reservoir. Upon actuation of the valve the nozzle delivers the charge of compressed air to the launch tube, propelling the projectile down the launch tube and into the air or at a selected target.

An additional unique feature in accordance with the present invention includes an impact-safe foam ball having a diameter of about 2½ inches, and a weight of about 0.15 oz. and being formed from an expanded EVA material having a density of about 2 lbs/ft$^2$. Another additional unique feature includes a launch tube formed of a clear acrylic tube and a strobe light for illuminating the launch tube during launch. Another additional unique feature includes a nozzle having a plurality of apertures adapted to create a substantially coherent high-velocity stream of air to propel a projectile down the launch tube by momentum transfer. Another additional unique feature includes a swivel-mounted base for allowing rotation of the projectile launcher in vertical and horizontal planes.

These and other unique features and advantages of the present invention will be readily apparent to those skilled in the art from the following detailed description of the preferred embodiments with reference to the accompanying drawings, the invention not being limited, however, to any particular preferred embodiment.

DESCRIPTION OF THE PREFERRED EMBODIMENTS

Figure 1:
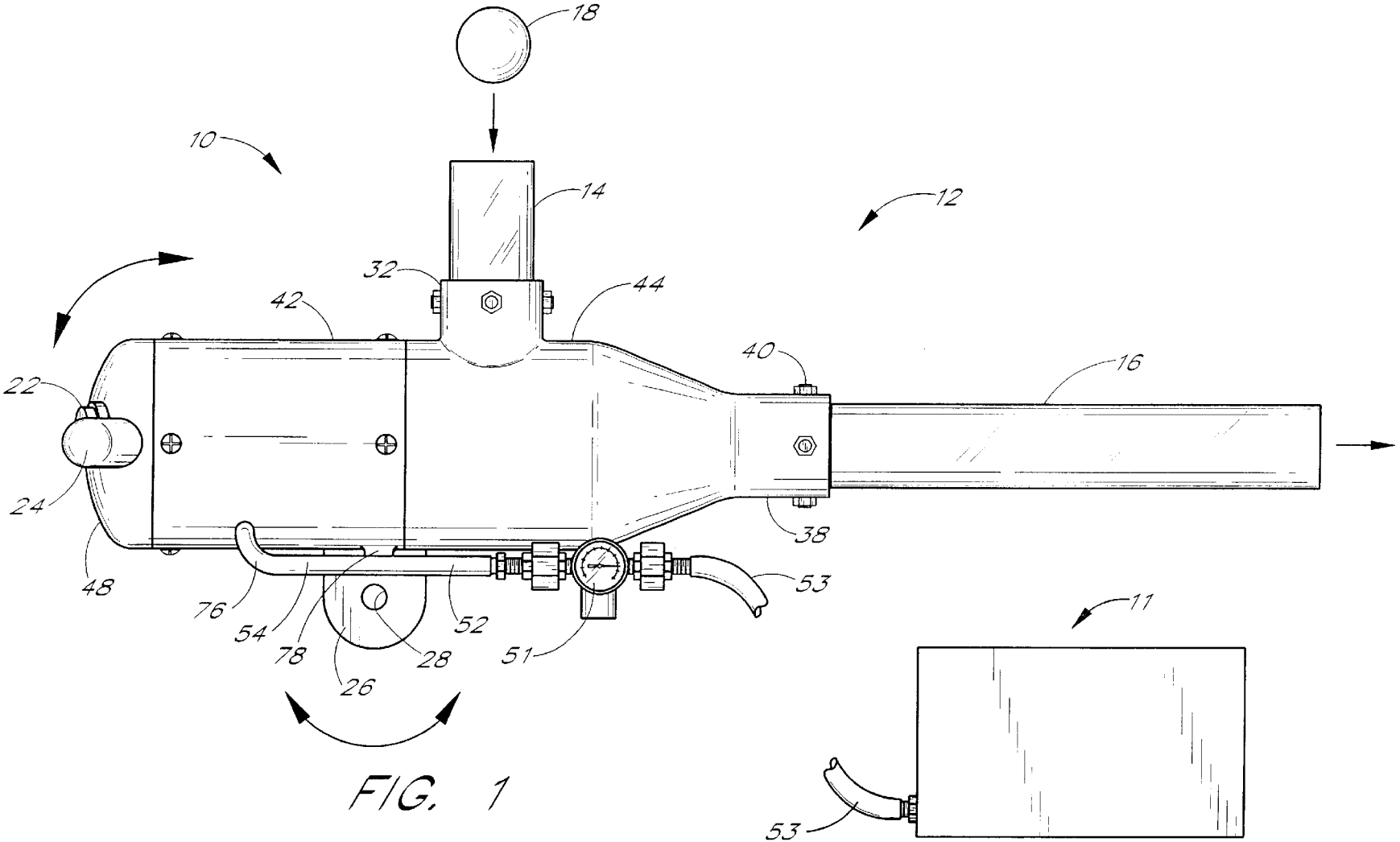
FIG. 1 is a side elevation view of one preferred embodiment of projectile launcher having features in accordance with the present invention.
Figure 2:
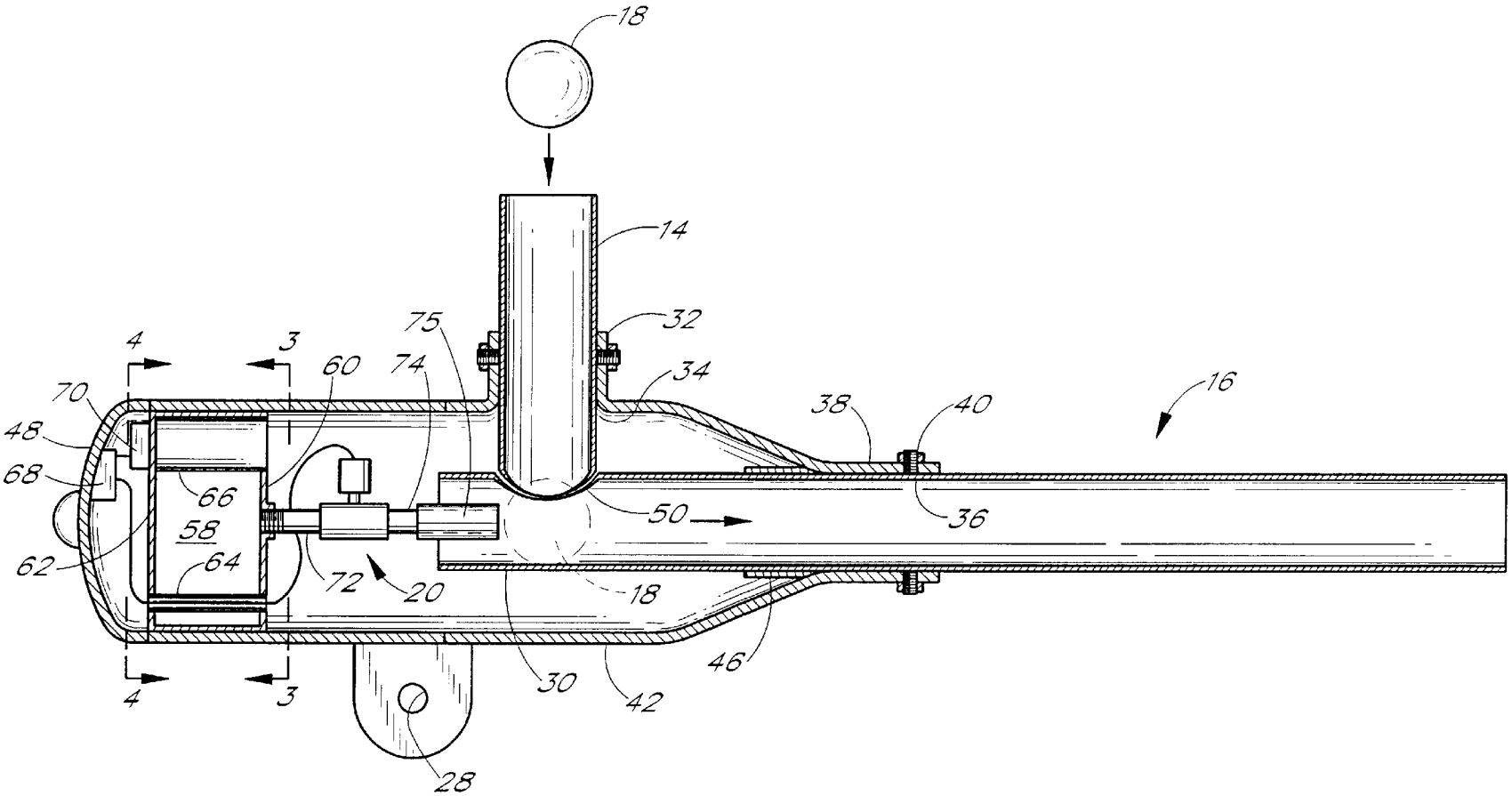
FIG. 2 is a partial cutaway side elevation view of the projectile launcher of FIG. 1.

FIGS. 1 and 2 show one possible embodiment of a participatory foam projectile launcher 10 having features in accordance with the present invention. It generally comprises a housing 12 having an inlet or feed tube 14 and a launch tube 16. As shown in more detail in FIG. 2 the feed tube 14 and launch tube 16 are preferably fabricated from clear acrylic cylinders and are arranged so as to intersect one another at the rear end 30 of the launch tube 16, substantially as shown. The feed tube 14 may be substantially vertical, as shown, or it may inclined or tilted, as desired. Those skilled in the art will appreciate that foam balls 18 or other impact-safe projectiles may be inserted into the feed tube 14 and will fall down into firing position at the end 30 of the launch tube 16.

A charge reservoir 58, defined by end plates 60, 62, is provided in the rear of the housing 12 for storing a charge of compressed air. The plates 60, 62 are welded to the interior of the main body 42 of the housing to provide a structurally sound and air tight chamber for containing the compressed air. The compressed air may be provided by an external compressed air source such as, for example, an electric air compressor or a hand-operated pump, as desired. The compressed air is communicated to the end 30 of the launch tube 16 via an air conduit 72 and a nozzle 74, which in the preferred embodiment, is fitted with an optional extension sleeve 75.

An electrically actuated solenoid valve 20 is interposed between the air conduit 72 and the nozzle 74, as shown, in order to control the flow of air directed into the end 30 of the launch tube 16. Those skilled in the art will readily appreciate that when the solenoid valve 20 is actuated, it permits the release of compressed air from the charge reservoir 58 to the nozzle 74. The nozzle converts the compressed air into one or more streams of high-velocity air which impinge on the ball 18, propelling it down the launch tube 16 and eventually launching it into the air or at a desired target up to 20 or 30 feet away or more.

The projectile itself is preferably a closed cell foam ball 18. Preferably, the ball 18 is fabricated from an expended ethylene vinyl acetate (EVA) material having a density of between about 1–5 lbs/ft$^3$ and, more preferably, a density of about 2 lbs/ft$^3$. The projectile may be spherical, as shown, or it may be provided in a wide variety of other shapes, as desired. Aerodynamic shapes are particularly preferred, although not required. For example, bullet or dart shaped projectiles may be used to enhance the accuracy and/or distance of the projectile. Spherical balls may be dimpled, if desired, to improve their aerodynamic properties.

The size and mass of the ball is preferably sufficient to produce a smooth trajectory without excessive wobbling or spiralling during flight. On the other hand, the projectiles are preferably impact-safe—that is, the size and mass of the projectile is preferably not so great as to produce a risk of injury to play participants upon impact, taking into account the impact velocity and the material composition of the projectile. It has been found that a ball diameter of about 2½ inches and a weight of about 0.15 oz. provides a particularly suitable compromise between these competing objectives. This correlates to a preferred EVA density of about 2 lbs/ft$^3$. Of course, other ball sizes ranging from about 1½–7 inches may also be used, depending upon the particular application and the distance, velocity and accuracy requirements. Preferably, the projectiles are not so small, however, as to present a choking hazard for young children or a slipping hazard when the projectiles are scattered about a floor or other supporting surface.

Referring in more detail to FIG. 1, it can be seen that an air hose 53 and an air supply line 54 provide pressurized air from an external compressed air source 11 to operate the projectile launcher 10. The compressed air source 11 may comprise, for example, a conventional electric-powered air compressor or, alternatively, it may comprise a hand-pump operated compressor such as shown and described in connection with FIGS. 13–15, discussed later. The compressed air source 11 can be positioned within, adjacent to or remote from the projectile launcher 10, as desired. It can also be configured to be operated or actuated by other play participants such that teamwork or cooperation among multiple play participants is required to operate the projectile launcher 10.

In the preferred embodiment shown an optional pressure gauge 51 is provided for allowing play participants to view the pressure of air in the supply lines 54, 53. This may be used, for example, to determine whether the air pressure is sufficient to propel the ball 18 at a desired velocity or to calibrate the projectile launcher 10 for desired distance accuracy. The pressure gauge 51 may be coupled to one end 52 of the air supply line 54, as shown, or it may be coupled to the charge reservoir 58 or compressed air source 11, as desired.

A pressure regulator and/or relief valve (not shown) is also preferably provided in the air source 11 and/or in the supply line 53 or projectile launcher 10 to ensure that safe air pressure levels are maintained during operation of the foam projectile launcher 10. An air pressure of about 40–60 PSI is adequate for satisfactory operation of the projectile launcher 10. If multiple foam projectile launchers are provided on a participatory play structure, an optional safety control manifold is preferably provided having a master control valve and pressure regulator and separate control valves and regulators for each air line 53 provided to each projectile launcher 10 or group of projectile launchers and/or other pneumatic devices. Advantageously, this enables individual control and adjustment of air pressure provided to each projectile launcher or group of projectile launchers.

Referring now to FIGS. 2–6 the solenoid valve 20 is preferably positioned in the central portion of the main body 42 adjacent the rear end 30 of the launch tube 16. A 2-way N.C. direct lift diaphragm valve, such as a ⅜" NPT #7221G solenoid valve, available from Honeywell, Inc., is preferred, although a wide variety of other commercially available solenoid valves may also be used. The solenoid valve is connected to the charge reservoir 58 via a coupler 72, preferably a ⅜ inch SS half coupler threaded into the plate 60, as shown.

Figure 2A:
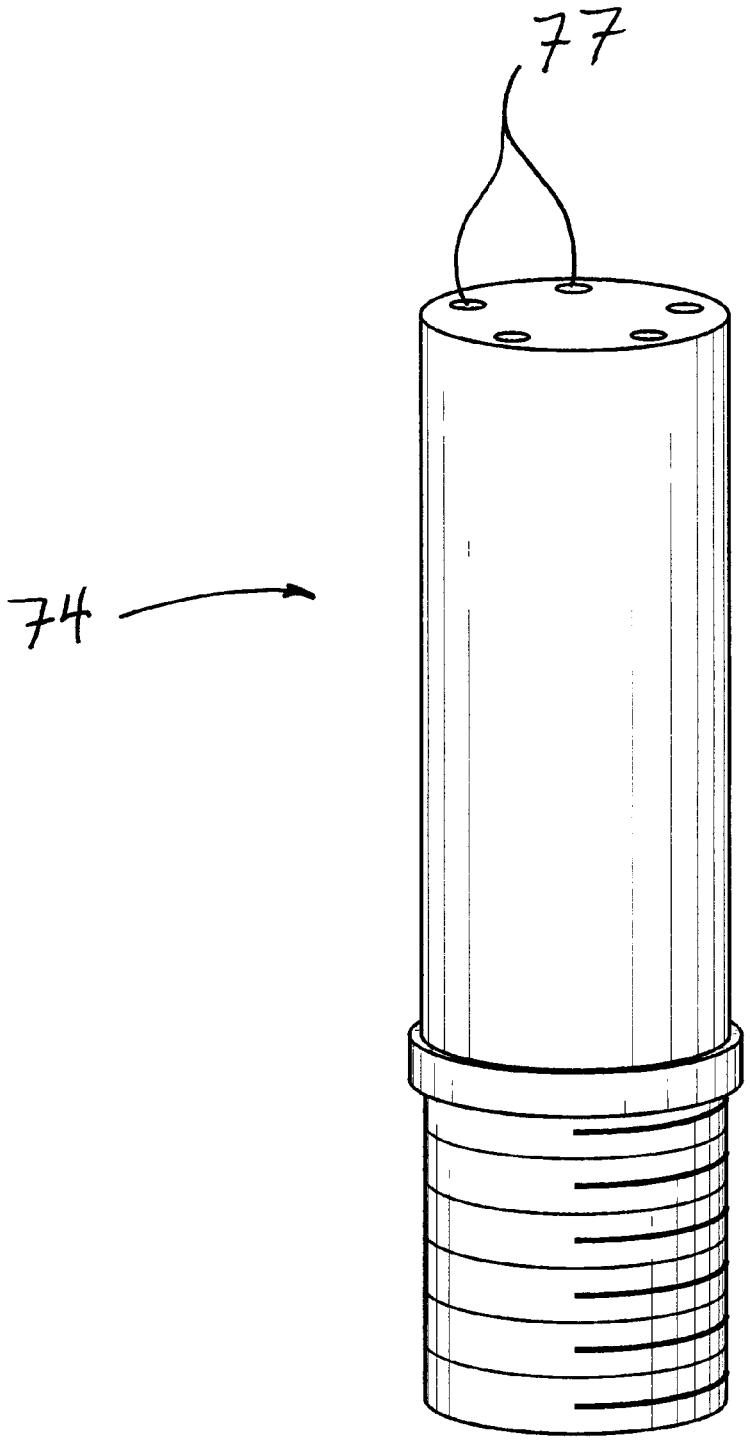
FIG. 2A is a perspective view of an ejector exhaust muffler adapted for use in the projectile launcher of FIG. 1.
Figure 4:
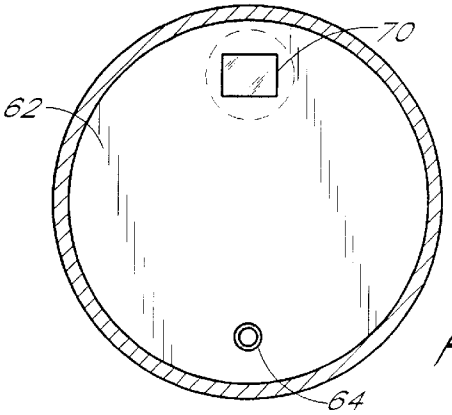
FIGS. 3 and 4 are cross-sectional views of the projectile launcher of FIG. 2, taken along section lines 3—3 and 4—4, respectively.

The nozzle 74 preferably comprises an ejector exhaust muffler, such as a ⅜"×2¼" #9837k23 ejector exhaust muffler, available from McMaster-Carr. The ejector exhaust muffler 74 having these features is shown in more detail in FIG. 2A. This particular nozzle has a plurality of discharge apertures 77 arranged in an annular pattern such that the resulting streams of air are concentrated in a narrow band over a relatively long distance. The nozzle body is preferably made of zinc-plated steel or other corrosion resistant material. A nylon collimator insert is provided within the nozzle body interposed between the inlet and outlet thereof in order to collimate the air flow stream. An optional extension sleeve 75 may be fitted on the end of the nozzle 74 to help direct the air stream behind the ball and/or to keep the ball from rolling backwards. This may be, for example, a simple polyethylene tube cut to a suitable length.

In operation, the nozzle 74 emits a stream of high-velocity air flow in a narrow annular band pattern. The stream of high-velocity air impinges on the ball 18 effecting momentum transfer from the high velocity air flow to the initially stationary ball 18. Preferably the discharge air flow is of sufficient velocity so as to impart significant motion to the ball 18, but not so high a velocity as to damage the ball 18 or pose a danger to play participants who may get in the path of the ball 18 or the discharge air flow. This may be adjusted by regulating the input air pressure and/or by selecting an appropriate nozzle having a suitable exit velocity and discharge band pattern.

Advantageously, this particular embodiment of the present invention uses momentum transfer to accelerate the ball 18 rather than pressure. This obviates the need to provide an air-tight seal between the ball 18 and the launch tube 16. Also, it is not necessary to close off the end 30 of the launch tube 16 during firing, as with conventional air guns. Thus, for example, no complicated breach-closure mechanism is required to close off the feed tube 14 during firing, as with a conventional air gun. This simplifies the design greatly and provides additional durability and safety for users since there are less moving parts to wear out or pose a hazard to fingers or hands inserted into the feed tube 14. This unique configuration also enables the exit velocity of the projectile to be more precisely regulated, providing additional safety.

A firing circuit, comprising a relay 68, push-button 22, and optional strobe light 70, is provided for operating the solenoid 20 and producing a strobing effect when the projectile launcher is actuated. The firing circuit is preferably powered by a low voltage power source (not shown), such as 12 VDC. This may be external or internal to the housing 12, as desired. The preferred construction and operation of the firing circuit is shown and described in more detail later in connection with FIGS. 7–8.

Figure 6:
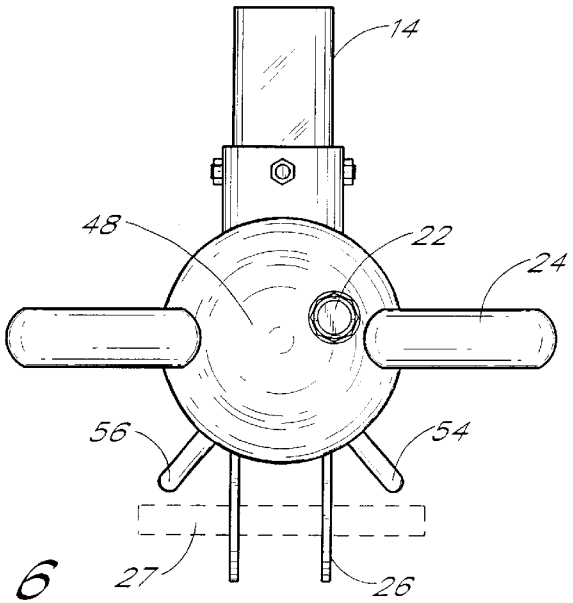
FIG. 6 is a rear elevation view of the projectile launcher of FIG. 1.
Figure 3:
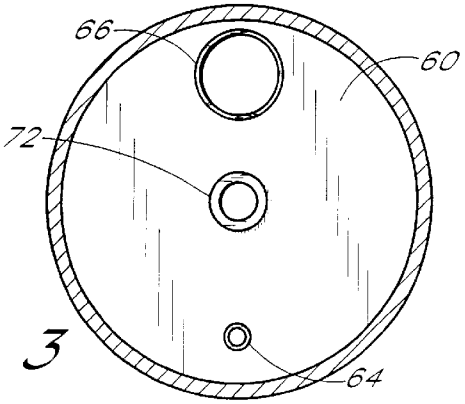
Figure 5:
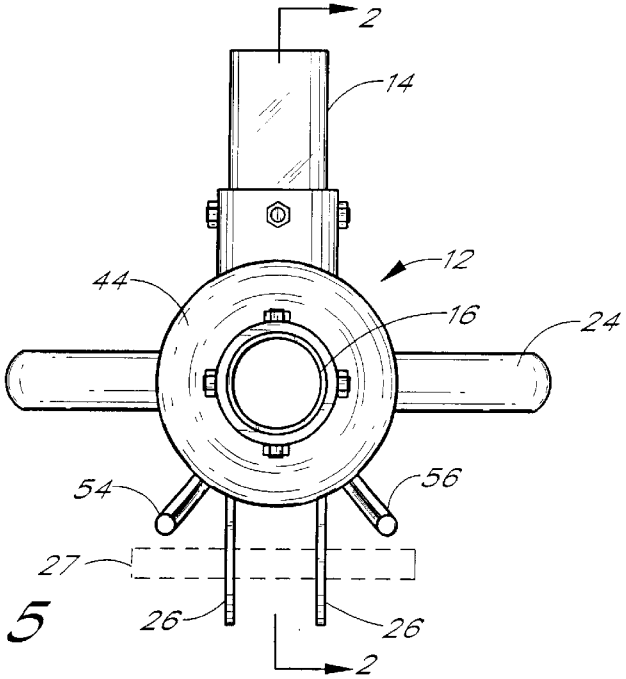
FIG. 5 is a front elevation view of the projectile launcher of FIG. 1.

A tube 56 (FIG. 6) is provided external to the housing 12 for routing electrical wiring from a power source (not shown) to the firing circuit disposed within the housing. Preferably, the tube 56 is symmetrically disposed on the housing 12 opposite the air line 54, which extends longitudinally along an exterior portion of the housing 12 as shown in FIGS. 1, 5 and 6. Additional tubes 64, 66 are provide internally within the housing 12 passing through the charge reservoir 58 for accommodating additional electrical wiring between the solenoid 20 and the relay 68 (small tube 64), and for accommodating transmission of light from the strobe light 70 to the clear acrylic launch tube 16 (large tube 66). Note that in the embodiment shown, the strobe light 70 is mounted on brackets attached to the proximal plate 62.

The smaller diameter tube 64 is preferably a ½ inch diameter, 2¾ inch long Schedule 10 SS pipe welded between the plates 60, 62. The larger diameter pipe 66 is preferably a 2 inch diameter, 2¾ inch long Schedule 10 SS pipe, welded between the two plates 60, 62. The interior of the larger tube may be polished or coated, as desired, to enhance the transmission of light from the strobe light 70 to the launch tube 16, much in the same manner as a light pipe. Appropriately sized holes are provided in the plates 60, 62 to accommodate the tubes 64, 66 therethrough.

A pair of mounting members 26 are provided for attachment to a swivel-mounted base or pedestal. The mounting members 26 are spaced apart horizontally, and are preferably located at a point along the longitudinal axis of the housing 12 such that the foam projectile launcher is approximately neutrally balanced. That is, the weight of the foam projectile launcher 10 distal the members 26 is approximately equal to the weight of the foam projectile launcher proximal the members, so that the projectile launcher 10 may be easily manipulated by play participants. A bearing member 27 (FIG. 5) extends through openings 28 of the mounting members 26 such that the projectile launcher 10 may be rotated in a vertical plane about the bearing member 27 and swivelled in a horizontal plane about a swivel-mounted base (not shown). Alternatively, other mounting arrangements may be used such as are known to those skilled in the art to allow the play participant to direct the trajectory of the balls launched from the foam projectile launcher 10.

A pair of handles 24 are provided on the rear of the housing 12, as shown, to enable play participants to easily manipulate the projectile launcher. The handles are formed on an end cap 48 at the proximal end of the housing 12. Alternatively, other means may be provided for gripping the projectile launcher 10, such as a knob, rifle grip, pistol grip or the like.

The housing 12 is preferably formed of stainless steel or other suitable corrosion resistant material. In the preferred embodiment, the main body 42 comprises a 6 inch Schedule 10 stainless steel (SS) pipe about 10 inches long, and the end cap 48 comprises a 6 inch Schedule 10 SS weld cap. The handles 24 are made from 1 inch diameter pipes about 4 inches long with weld cap ends. Conventional bolt fasteners are used to attach the various components of the housing 12 together.

Appropriately sized holes are provided on the sides of the main body 42 for attachment of the air supply and electric feed lines 54, 56. The air supply line 54 is about 5½ inches long and the electric feed line 56 is about 7½ inches long and may be formed from ½ inch SS pipe. The ends of the tubes are welded to the main body 42 and are preferably ½ inch SS threaded elbow joints 76. The other ends of the tubes may be ⅜ inch SS half couplers 52. The half coupler of the air supply tube 54 may be used with a ⅜ NPT×⅜ JIC adaptor for connection to the external air supply. A one inch long flange or web 78 (FIG. 1) is preferably attached adjacent the half coupler 52 and on the opposite side for supporting each tube 54, 56 against the exterior of the main body 42 of the housing.

As noted above, the launch tube 16 and feed tube 14 are preferably constructed of clear acrylic or other suitable material. In the preferred embodiment shown, these are 2⅞ inch diameter acrylic cylinders with about 3/16 inch thick walls. The cylinders 14, 16 are preferably sized so as to allow free passage of the balls 18 through the tubes with little frictional resistance. The feed tube 14 is preferably about 12 inches long, and the launch tube 16 is preferably about 24 inches long. The lower end of the feed tube 14 is coped or shaped to mate with a corresponding opening 50 formed on the upper surface of the end 30 of the launch tube 16, as shown.

A mount sleeve 32 is used to attach the feed tube 14 to an opening 34 at the top of the housing 12. The launch tube 16 is secured to the housing via a similar mount sleeve 38 mated to a middle section 36 of the launch tube 16 and secured by one or more retaining screws 40. The mount sleeve 38 preferably extends forward from the main body 42 of the housing, as shown. An optional bushing or sleeve 46, may be welded to the interior of the housing 42 adjacent the sleeve 38, to snugly receive and support the launch tube 16. The mount sleeves 32, 38 are preferably 3 inch Schedule 40 SS pipes.

In operation the projectiles to be launched, in this case foam balls 18, are inserted into the feed tube 14. This may be a hand-loading operation, or it may be a continuous feed operation such as via a conduit or basket/hopper (not shown), as desired. The charge reservoir 58 is then filled with compressed air to power the launcher 10. To launch the projectile, a play participant pushes the push-button 22 which activates an electronic firing circuit (described later). The firing circuit causes the relay 68 to send an actuation signal to the solenoid 20 and another signal to actuate the strobe light 70. Thus, the ball 18 is propelled down the launch tube 16 and launched into the air as the strobe light 70 illuminates the launch tube 16 simulating the flash of a gun powder explosion. Those skilled in the art will appreciate that the firing circuit can be either a "single shot" or "multiple/repeating shot" as desired. Both of these embodiments are described in more detail below.

Figure 7:
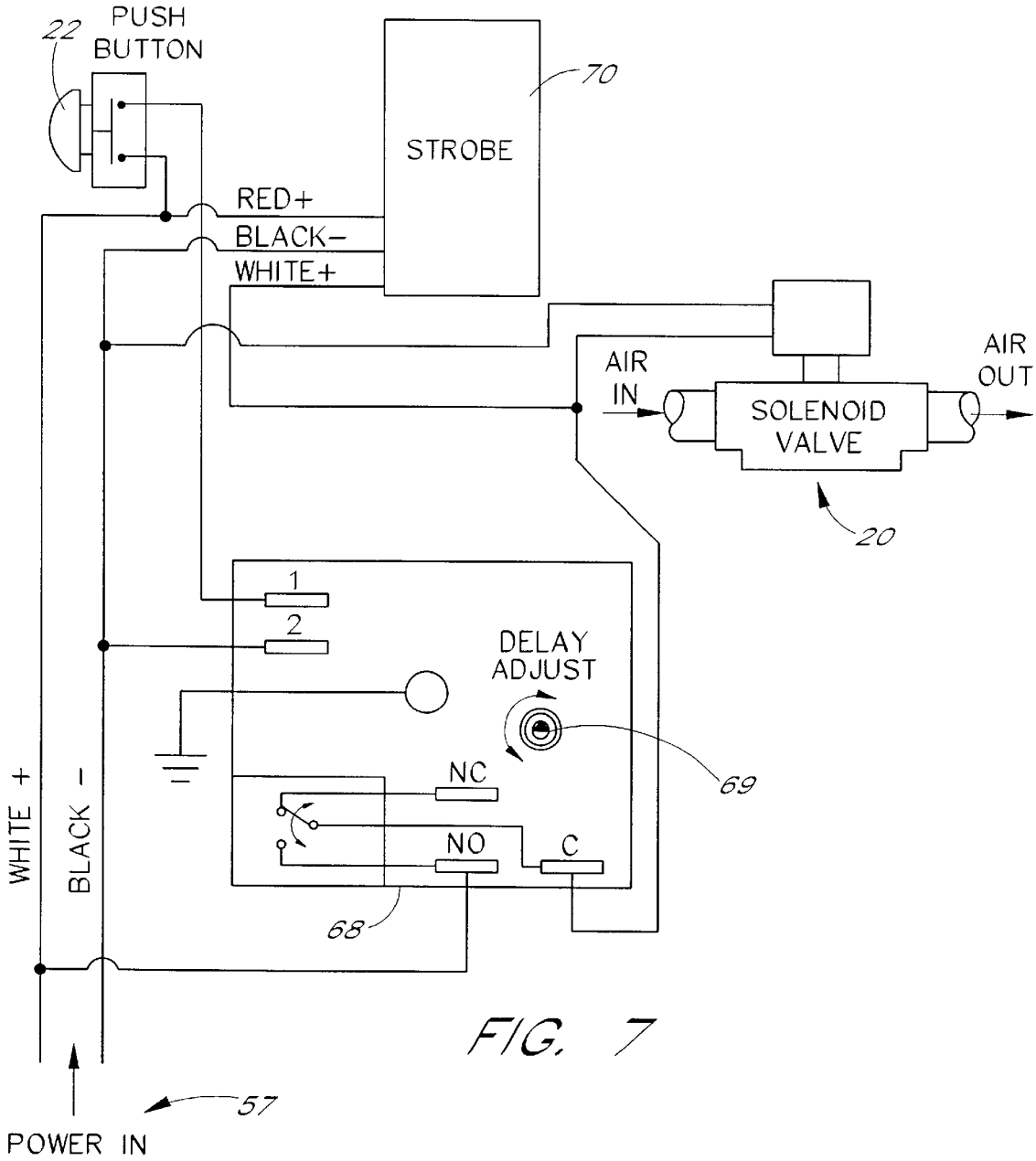
FIG. 7 is a simplified electrical schematic wiring diagram of a firing circuit for a single shot projectile launcher having features in accordance with the present invention.

FIG. 7 is a simplified electrical schematic wiring diagram of a firing circuit for a single shot foam projectile launcher having features in accordance with the present invention.

The firing circuit basically comprises a push-button 22, a time delay relay 68 and a solenoid valve 20. An optional strobe light 70 may also be provided, if desired. The time delay relay 68 has a time delay adjustment dial 69 for controlling the duty cycle of the solenoid valve 20 and/or the strobe light 70. If desired, another time delay adjustment (not shown) can be used to control the "off duty" time or the minimum delay time between successive launches in order to ensure adequate pressurization for each shot, or to limit the number of shots allowed to be fired per minute.

In operation, when the push-button 22 is momentarily depressed the relay 68 is energized by a voltage applied across terminals 1 and 2. The relay switches to its "ON" state closing the circuit between the "C" terminal and the "NO" terminal for a predetermined duty cycle as set by the time delay adjustment dial 69. A 0.2 second duty cycle should be sufficient for most applications. This, in turn, energizes the solenoid valve 20 causing it to open for the predetermined duty cycle and also energizes the strobe light 70. When the relay timer clocks out, the relay returns to its "OFF" state and the NO and NC terminals resume to their normally open and normally closed states, respectively. The circuit is then ready to be activated again by push-button 22.

Figure 8:
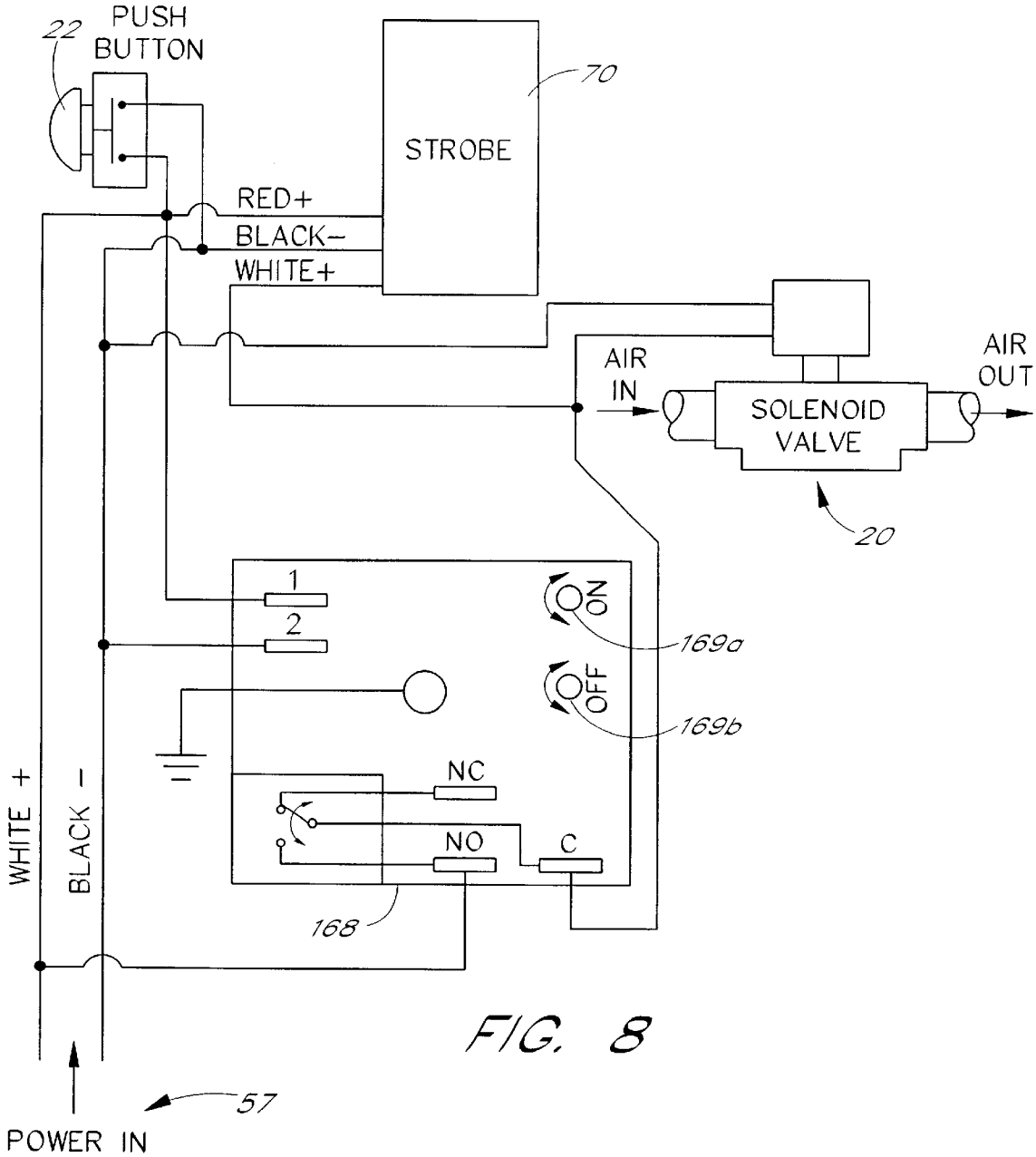
FIG. 8 is a simplified electrical schematic wiring diagram of a firing circuit for a rapid shot or repeating shot projectile launcher having features in accordance with the present invention.

FIG. 8 is a simplified electrical schematic wiring diagram of a firing circuit for a rapid shot or repeating shot foam projectile launcher having features in accordance with the present invention. In this embodiment, the time delay relay 168 is adapted to provide successive switching of activation power to the solenoid such that a plurality of balls 18 can be sequentially propelled from the launch tube 16 when the bottom 22 is depressed. The longer the button 22 is depressed, the more firing cycles are completed. Operation of the repeating shot firing circuit is substantially the same as the single shot circuit described above, except that two time delay adjustment dials 69*a,* 69*b* are provided for adjusting the "ON" duty cycle time and the "OFF" duty cycle time for each firing cycle. An "ON" duty cycle of about 0.2 seconds should be sufficient for most applications. The minimum number of shots and their timing intervals may be selected as desired by adjusting the relay and/or modifying the firing circuit, as desired.

The relays 68, 168 and connections to the power source 57, push button 22, strobe light 70, and solenoid valve 20 are all commercially available components from well known sources. Suitable relays for the single shot and repeating shot firing circuits may include, for example, Digi-Timer Relays # KRD1120 and #KRDR120A0, respectively, available from SSAC Inc. Suitable strobe lights may include the D.C. Mini-Strobe from Flash-Works, Inc. Suitable solenoid valves may include the Direct Lift and Pilot Operated General Service Valve #7221GBN3VN00 available from Honeywell, Inc. Other suitable components may also be used as desired.

Figure 9:
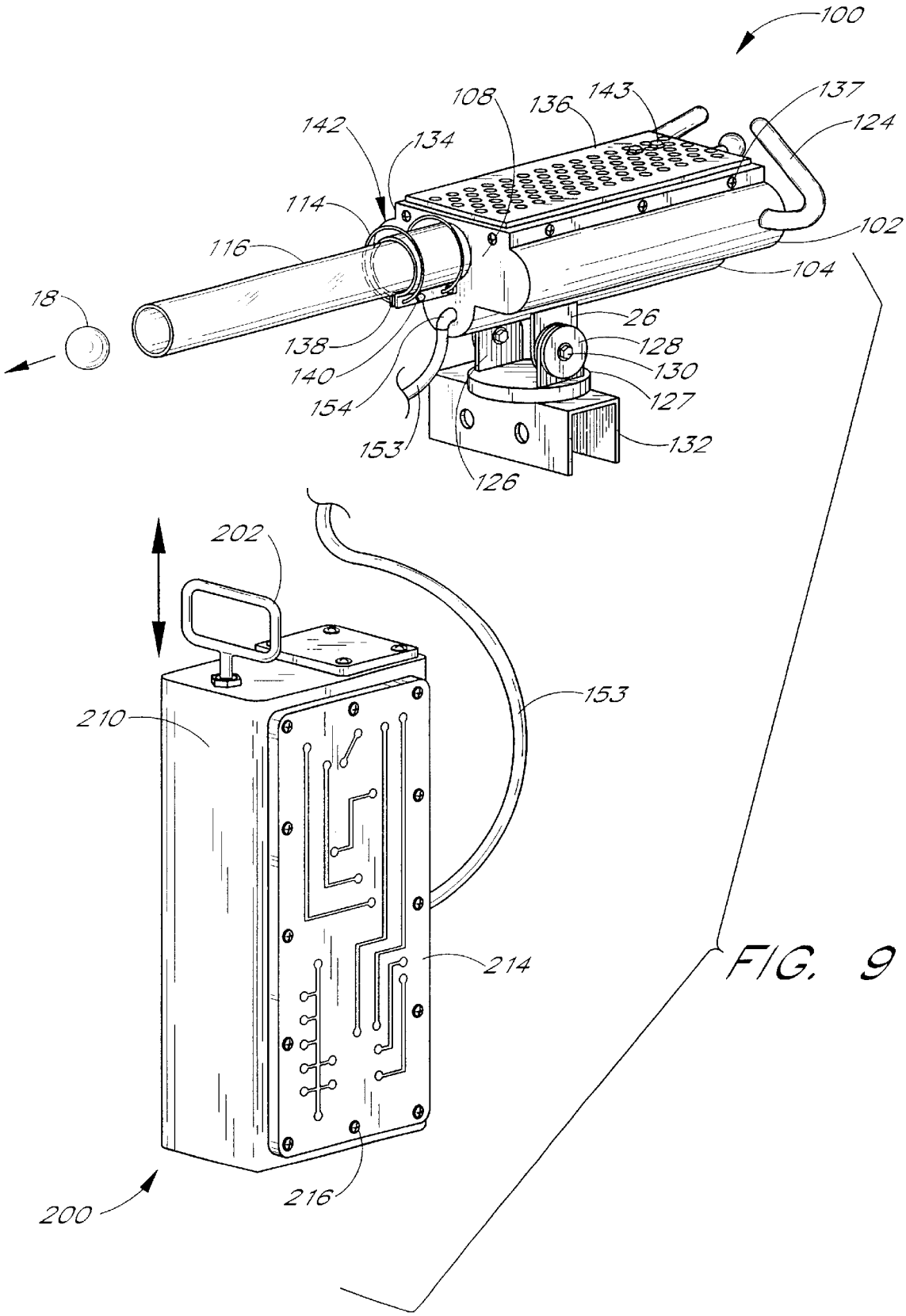
FIG. 9 is a perspective view of another preferred embodiment of a projectile launcher and air pump unit having features in accordance with the present invention.

FIG. 9 is a perspective view of another preferred embodiment of a participatory foam projectile launcher 100 and an associated air pump unit 200 having features in accordance with the present invention. In this embodiment, the projectile launcher 100 is connected via a flexible air hose 153 to a manually-operated external air supply unit 200.

Figure 10:
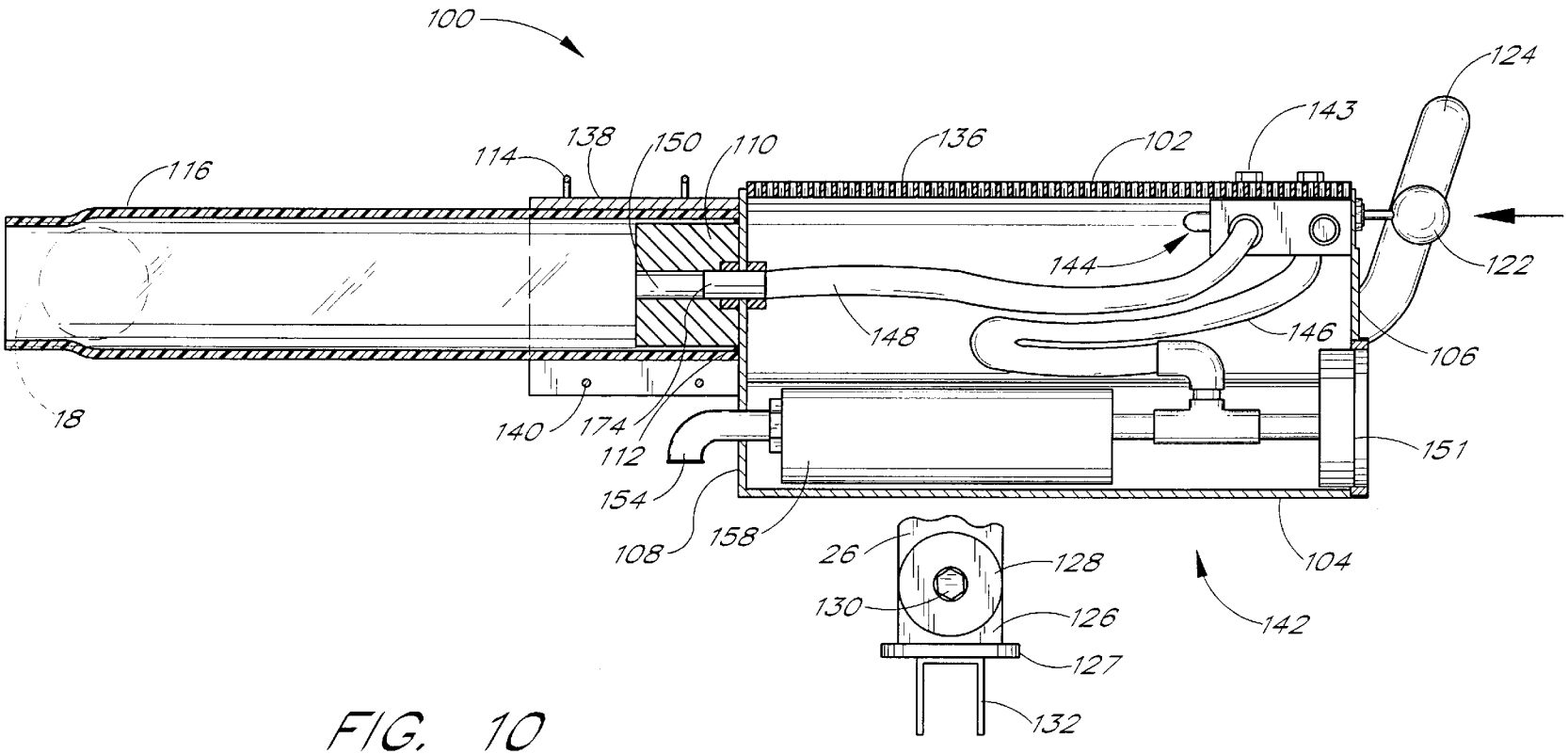
FIG. 10 is a partial cutaway schematic view of the interior of the housing of the projectile launcher of FIG. 9.

As shown in more detail in FIG. 10, the projectile launcher 100 generally comprises a housing 142, and a launch tube 116 secured to the distal end of the housing via a compression clamp 138. The launch tube 116 is sized to fit snugly against the ball 18 to provide a substantially air-tight seal. The tip of the launching tube may be slightly smaller in order to provide a slight interference fit, as shown. Those skilled in the art will appreciate that foam balls 18 or other impact-safe projectiles may be inserted into the end of the launch tube 116, as shown.

A charge reservoir 158, is provided in the lower portion of the housing 142 for storing a charge of compressed air. The compressed air may be provided by an external compressed air source such as an electric air compressor as described above, or, more preferably, by a hand-operated pump 200, as will be described in more detail below. The compressed air in the charge reservoir 158 is communicated to the proximal end of the launch tube 116 via air hoses 146, 148 and discharge nozzle 174.

A manually-operated air control valve 144 is interposed between the charge reservoir 158 and the nozzle 174, as shown, in order to control the flow of air directed into the proximal end of the launch tube 116. Those skilled in the art will readily appreciate that when the air control valve 144 is opened, it permits the release of compressed air from the charge reservoir 158 to the nozzle 174. The nozzle injects this compressed air into the launch tube 116, compressing the air in the launch tube 116 behind the ball 118. Eventually the pressure of the air behind the ball 18 becomes great enough to eject the ball 18 from the launch tube 116, launching it into the air or at a desired target up to 20 or 30 feet away or more.

Figure 12:
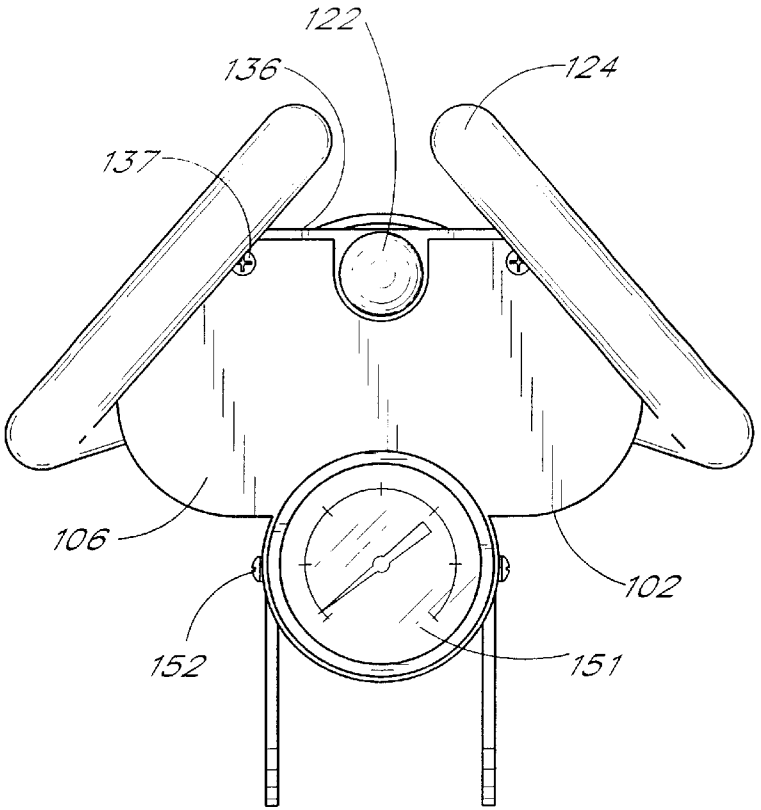
FIG. 12 is a rear elevational view of the projectile launcher of FIG. 9.
Figure 11:
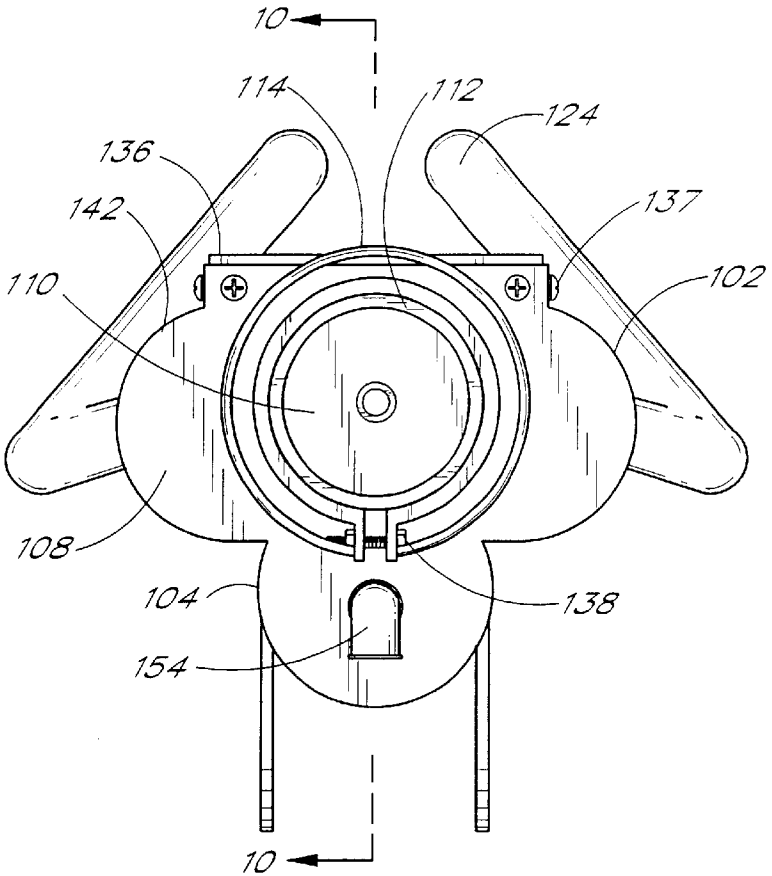
FIG. 11 is a front elevational view of the projectile launcher of FIG. 9.

Referring in more detail to FIGS. 10–12, it can be seen that the launch tube 116 is secured to the housing 142 via a compression clamp 138, which is welded or otherwise attached to the forward plate 108 of the housing 142. The launch tube is inserted into the compression clamp 138 and the clamp is tightened via a pair of nut and bolt fasteners 140 to secure the launch tube 116 in place. To enhance the visual appeal of the projectile launcher 100, a pair of rings 114 are provided about the clamp 138 comprising steel wire rods welded at their ends to the flats of the clamp.

An annular plug 110 is disposed within the launch tube 116 adjacent the housing. The plug 110 has a hole extending therethrough sized and shaped so as to allow insertion of the nozzle 174 and communication of compressed air into the launch tube 116. An air-tight seal is provided between the launch tube 116 and the plug 110 via an O-ring 112, as shown in FIG. 10.

As noted above, compressed air is delivered from the charge reservoir 158 to the launch tube 116 via the nozzle 174. This nozzle 174 may be a ejector exhaust muffler, as described above, or it may be a simple discharge nozzle or orifice, as desired. Preferably, the nozzle is selected and/or adjusted to deliver a sufficient rate of compressed air so as to rapidly expel the ball 18, but not so high a rate of discharge air flow as to damage the ball 18 or pose a danger to play participants who may get in the path of the ball 18 or discharge air flow. Again, this may be adjusted by regulating the input air pressure and/or by selecting an appropriate nozzle having a suitable exit velocity and discharge band pattern.

The air control valve 144 may be of any one of a variety of suitable and commercially available control valves, such as the #K41DA00 available from NORGREN in Littleton, Colo. An optional pressure gauge 151 may also be provided, as shown, for displaying the pressure of the air contained in the tank 158. Again, this may be used to determine whether the air pressure is sufficient to propel the ball 18 at a desired velocity or to calibrate the projectile launcher 100 for desired distance accuracy. The pressure gauge 151 may be coupled to the charge reservoir, 158, as shown, or it may be coupled to the inlet 154 of the charge reservoir or to the compressed air source, as desired.

The housing 142 itself is preferably formed of corrosion resistant material such as stainless steel. The main body portions 102, 104 of the housing 142 are illustrated as substantially oval or cylindrical in shape. Those skilled in the art will appreciate that a wide variety of other shapes may also be used, such as square, circular, rectangular or the like. The top of the housing 142 comprises a substantially rectangular section 134 onto which is attached a ventilated access panel 136. The panel 136 is fastened using a plurality of screws 137 and detaches to enable maintenance and repairs to be readily performed.

A pair of apertured mounting members 26 are provided on the bottom of the housing 142, as shown. A mating pair of apertured mounting members 126, plastic disks 128 and fasteners 130 are pivotably attached to the members 26 at apertures 28 (not visible). This arrangement allows vertical rotational displacement of the projectile launcher 100. The lower ends of the mating members 126 are welded to a plate 127 rotatably attached to a U-shaped mounting bracket 132, as shown, to provide horizontal swivel motion. Appropriate bearing supports and fasteners are used to attach the plate 127 to the bracket 132. The U-shaped bracket 132 is bolted to a structural support, such as a pedestal or railing. Thus, the protectable launcher 100 can be directed up or down, left or right, as desired. A pair of handles 124 on the housing allows play participants to easily manipulate the projectile launcher to adjust the trajectory of the ball 18.

Figure 14:
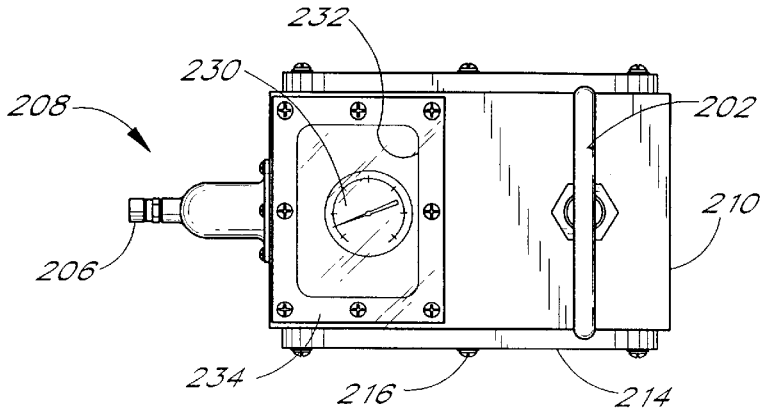
FIG. 14 is a top plan view of the air pump unit of FIG. 9.
Figure 15:
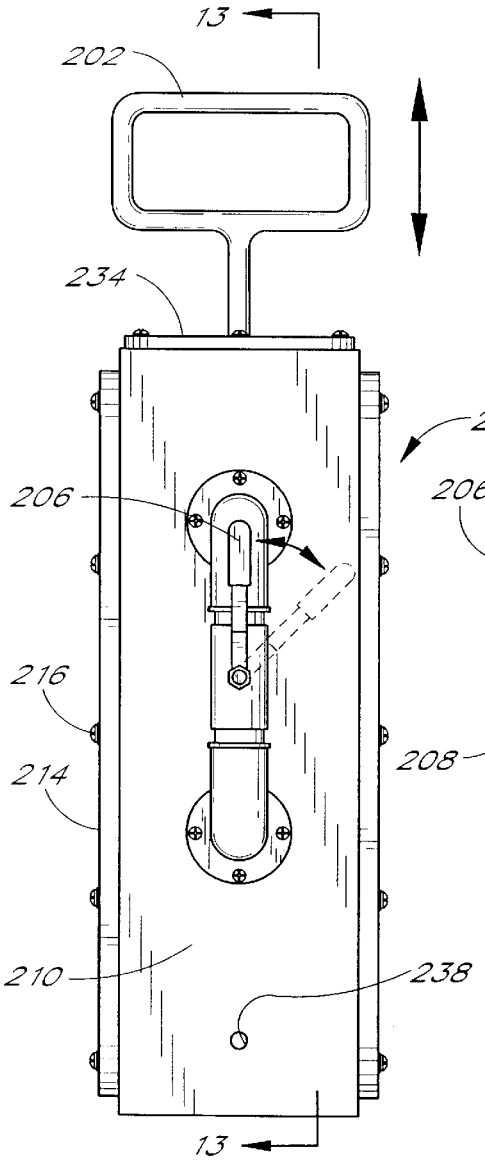
FIG. 15 is a side elevational view of the air pump unit of FIG. 9.
Figure 13:
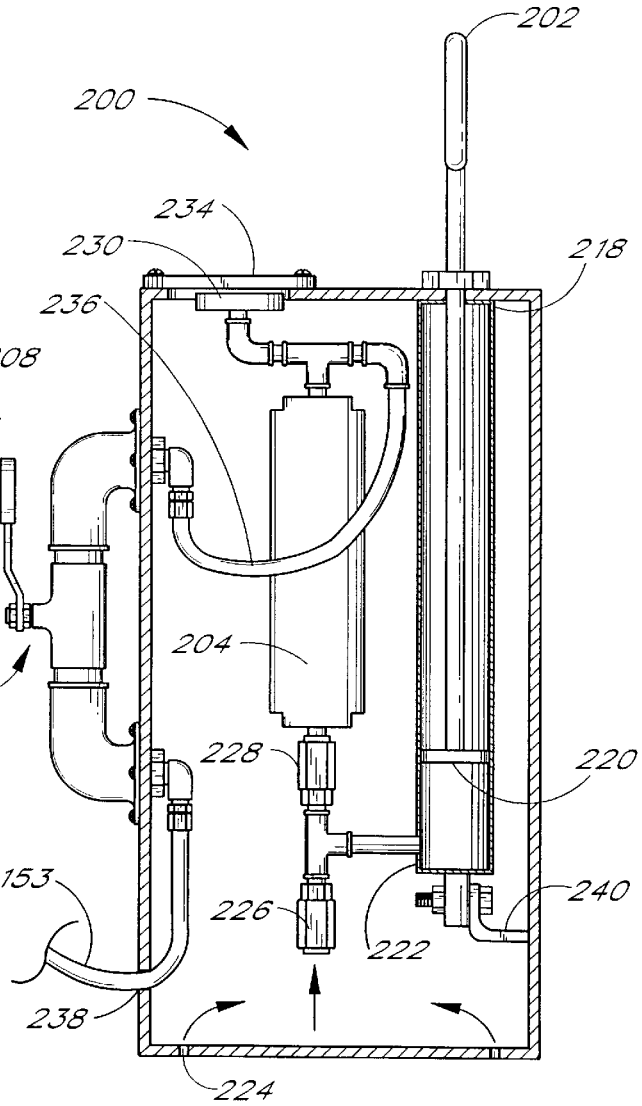
FIG. 13 is a partial cutaway schematic view of the interior of the housing of the air pump unit of FIG. 9.

FIGS. 13–15 illustrate one possible embodiment of an air supply unit 200 having features of the present invention. The air supply unit 200 generally comprises a housing containing a compression cylinder 222, air reservoir 204, pressure gauge 230, flow control valve 208, and appropriate check valves 226, 228. A handle 202 is provided to enable a play participant to pump a piston 220 within the cylinder 222, to pump compressed air into the air reservoir 204. Air is drawn into the cylinder 222 through a first check valve 226 on an upstroke of the piston 220. Air is directed through a second check valve 228 into the air reservoir 204 on a downstroke of the piston.

The reservoir 204 is connected to a flexible air hose 236 which connects the reservoir 204 with an exterior manifold and control valve 208. The control valve 208 may be opened or closed manually by a play participant to connect the air supply unit 200 to a projectile launcher via flexible air hose 153. A CLOSED or horizontal position of the lever 206 disconnects the pump unit 200 from the air nose 153. An OPEN or vertical position of the lever 206 connects the pump unit 200 to the air hose 153. If desired, the air pressure in the reservoir 204 may be displayed by a pressure gauge 230 visible through an opening 232 provided in the top of the housing. A section of plexiglass 234 may be secured over the opening 232 to allow viewing of the gauge 230 while preventing unwanted access to the housing interior.

The pump cylinder 222, check valves, 226, 228, air reservoir 204, and control valve 208 are all commercially available components from well-known sources. For example, the pump cylinder 222 may be a BIMBA cylinder #3112 DXP. This particular cylinder has about a 2" diameter and a 12" stroke. The check valves 226, 228 may be KINGSTON #226 ⅜" check valves. The air reservoir 204 may be a 2" BIMBA #D11846-A6. The air control valve 208 may be a #8201, 150WSP-400WOG OPEN/CLOSE valve from Hammond Valve Corp.

The housing of the air supply unit 200 comprises a frame 210 having substantially rectangular side walls. The larger side walls comprise border portions 212 and are otherwise substantially open to allow access to the interior components. Cover plates 214 are attached to the frame 210 using screws 216. If desired, the cover plates 214 can be decorative as shown. These can be made from plastic or foam, for example, or the cover plates 214 can be acrylic or plexiglass, as desired, to allow viewing of the cylinder 222, air reservoir 204, air hose 236 and other interior components.

The frame is constructed of stainless steel sections about ¼" thick, with smaller sections measuring about 6"×21", and larger sections measuring about 10"×21". The bottom of the housing is about 5½"×9½" having four 7/16" diameter holes 224. The top is about 5½"×9½" and has a 1⅜" diameter hole 218 for mounting the pump cylinder 222, and a 4"×4" opening 232 for mounting the pressure gauge window 234. The plexiglass cover 234 over the opening 232 is about ⅜" thick and measures about 5"×5½".

In all of the embodiments of the invention heretofore shown and described, the exterior of each of the projectile launchers and/or pump supply units may be shaped, decorated or otherwise configured to match or compliment a "theme" of a particular play structure or play environment. For example, a medieval castle, lost temple, military fort or fire station can each provide an exciting play theme for a play structure and/or projectile launcher having features and advantages as taught herein. A war zone with old WWII fighter aircraft depicted around the play structure may provide another exciting play theme. In that case, a foam projectile launcher mounted within a plexiglass turret depending below a raised platform, may provide an exciting enhancement to the overall theme of the play structure. As another example, brightly colored foam, plastic, or metal pieces could be attached to the housing of a foam projectile launcher to create a structure resembling a robot, circuit board, factory machinery or other fanciful structure, as desired. The number and variety of play theme possibilities is virtually endless, but all are contemplated to be within the scope of the invention as herein disclosed.

In another preferred embodiment, a plurality of foam projectile launchers can be strategically located throughout a play structure to provide multiple participatory play opportunities and competition among play participants. Foam projectile launchers may be placed in towers or positioned to shoot through portholes or the like. One or more projectile launchers can also be mounted on a rotating platform having a seat, so that a participant can sit and spin around while shooting, like in a gun turret of a battleship. In yet other embodiments, projectile launchers may be provided on moving platforms to simulate tanks, battleships, airplanes or other vehicles which may be controlled either by the play participants or another persons. Again, the possibilities for thematic variations are virtual endless.

The preferred embodiments shown and described herein are provided merely by way of example and are not intended to limit the scope of the invention in any way. Preferred dimensions, materials and construction techniques are all illustrative only and are not necessarily required to practice the invention. It is intended that the scope of the present invention herein disclosed should not be limited by the particular disclosed embodiments herein, but should be defined only by a fair reading of the claims that follow.

What is claimed is:

1. An impact-safe projectile launcher for propelling projectiles, the projectile launcher comprising:

a launch tube died to accommodate insertion of an impact-safe projectile with substantially little to no friction between the launch tube inner wall and the projectile;

a nozzle disposed adjacent one end of the launch tube, the nozzle being adapted to receive a flow of compressed air, to accelerate the flow of compressed air to form a stream of high-velocity air, and to direct the stream of high-velocity air at the projectile disposed within the launch tube; and a play-participant actuated valve interposed between the nozzle and a source of compressed air, the valve being adapted when actuated to place the nozzle in communication with the source of compressed air;

whereby upon actuation of the valve, the nozzle discharges the stream of high-velocity air which transfers momentum to the projectile, propelling it down the launch tube and into the air.

2. The projectile launcher of claim 1 wherein the launch tube comprises a clear acrylic tube having an inner diameter that is at least slightly larger than the diameter of the projectile.

3. An impact-safe projectile launcher for propelling projectiles, the projectile launcher comprising:

a launch tube sized to accommodate insertion of an impact-safe projectile with substantially little to no friction between the launch tube inner wall and the projectile;

a nozzle disposed adjacent one end of the launch tube, the nozzle being adapted to receive a flow of compressed air and to direct a stream of high-velocity air at the projectile disposed within the launch tube; and a play-participant actuated valve interposed between the nozzle and a source of compressed air, the valve being adapted when actuated to place the nozzle in communication with the source of compressed air;

whereby upon actuation of the valve, the nozzle discharges a stream of high-velocity air which transfers momentum to the projectile, propelling it down the launch tube and into the air wherein the nozzle has a plurality of apertures adapted to create a substantially coherent high-velocity stream of air.

4. The projectile launcher of claim 1 wherein the nozzle comprises an ejector exhaust muffler.

5. The projectile launcher of claim 1 wherein the play participant actuated valve comprises a solenoid valve.

6. The projectile launcher of claim 1 further comprising a swivel-mounted base for allowing rotation of the projectile launcher in vertical and horizontal planes.

7. The projectile launcher of claim 1 further comprising an air reservoir for storing a charge of compressed air.

8. The projectile launcher of claim 7 further comprising a pressure gauge coupled to the air reservoir.

9. An impact-safe projectile launcher for propelling projectiles, the projectile launcher comprising:

a launch tube sized to accommodate insertion of an impact-safe projectile with substantially little to no friction between the launch tube inner wall and the projectile;

a nozzle disposed adjacent one end of the launch tube, the nozzle being adapted to receive a flow of compressed air and to direct a stream of high-velocity air at the projectile disposed within the launch tube; and a play-participant actuated valve interposed between the nozzle and a source of compressed air, the valve being adapted when actuated to place the nozzle in communication with the source of compressed air; and a strobe light for illuminating the launch tube whereby upon actuation of the valve, the nozzle discharges a stream of high-velocity air which transfers momentum to the projectile, propelling it down the launch tube and into the air.

10. The projectile launcher of claim 1 further comprising a feed tube for delivering projectiles into the launch tube.

11. The projectile launcher of claim 10 wherein the feed tube is connected to a substantially continuous source of projectiles.

12. The projectile launcher of claim 1 in combination with an impact-safe foam ball having a diameter of about 2½ inches, and a weight of about 0.15 oz. and being formed from an expanded ethylene vinyl acetate material having a density of about 2 lbs/ft$^3$.

13. A plurality of projectile launchers as set forth in claim 1 organized into at least one group of projectile launchers, each group comprising at least one projectile launcher, in combination with a safety control manifold having a master control valve and pressure regulator and separate control valves and regulators for each air line provided to each group of projectile launchers.

14. The projectile launcher of claim 1 wherein the play participant actuated valve comprises a manually operated valve.

15. A projectile launcher comprising:

a launch tube substantially sealed at a first end and being sized and configured so as to accommodate insertion and launching of an impact-safe projectile, the impact-safe projectile having a size and mass adapted to safely impact a child, the launch tube having an inner diameter that is least slightly smaller at a second and than the diameter of the projectile;

an air reservoir for containing compressed air;

a nozzle disposed adjacent the sealed end of the launch tube, the nozzle being adapted to receive the compressed air and to deliver it to the launch tube between the projectile and the sealed end of the launch tube;

a valve interposed between the nozzle and the air reservoir, the valve being adapted when actuated to place the nozzle in communication with the air reservoir; and a strobe light for selectively illumining the launch tube whereby upon actuation of the valve, the nozzle delivers the compressed air to the launch tube, expelling the projectile from the launch tube and into the air.

16. The projectile launcher of claim 1 in combination with an impact-safe foam ball having a diameter of about 2½ inches, and a weight of about 0.15 oz. and being formed from an expanded ethylene vinyl acetate material having a density of about 2 lbs/ft$^3$.

17. A plurality of projectile launchers as set forth in claim 1 organized into at least one group of projectile launchers, each group comprising at least one projectile launcher, in combination with a safety control manifold having a master control valve and pressure regulator and separate control valves and regulators for each air line provided to each group of projectile launchers.

18. An impact-safe projectile launch system comprising an impact-safe projectile constructed of foam and adapted to minimize the risk of injury to a child upon impact and a projectile launcher, the projectile launcher comprising:

a housing;

a launch tube sized and configured so as to accommodate insertion of the impact-safe projectile with substantially little to no friction between the launch tube inner wall and the projectile;

an air reservoir for containing a charge of compressed air;

a manual play-participant-operated pump operated to pump a charge of compressed air into the air reservoir;

a nozzle disposed adjacent one end of the launch tube, the nozzle being adapted to receive a flow of compressed air, to accelerate the flow of compressed air to form a stream of high-velocity air, and to direct the stream of high-velocity air at the projectile disposed within the launch tube; and a valve interposed between the air reservoir and the launch tube, the valve being adapted when actuated to place one end of the launch tube in communication with the air reservoir;

whereby upon actuation of the valve, the nozzle discharges the stream of high-velocity air which transfers momentum to the projectile, propelling it down the launch tube and into the air.

19. The impact-safe projectile launch system of claim 18 wherein the launch tube comprises a clear acrylic tube.

20. The impact-safe projectile launch system of claim 18 further comprising a nozzle disposed adjacent one end of the launch tube, the nozzle being adapted to receive a flow of compressed air to discharge a stream of high-velocity air impinging upon the projectile disposed within the launch tube.

21. The impact-safe projectile launch system of claim 20 wherein the nozzle comprises an ejector exhaust muffler.

22. The impact-safe projectile launch system of claim 18 wherein the valve comprises a play-participant-actuated solenoid valve.

23. The impact-safe projectile launch system of claim 18 further comprising a swivel-mounted base for allowing rotation of the projectile launcher in vertical and horizontal planes.

24. The impact-safe projectile launch system of claim 18 further comprising a pressure gauge coupled to the air reservoir.

25. An impact-safe projectile launch system comprising an impact-safe projectile constructed of foam and adapted to minimize the risk of injury to a child upon impact and a projectile launcher, the projectile launcher comprising:

a housing;

a launch tube sized and configured so as to accommodate insertion of the impact-safe projectile;

an air reservoir for containing a charge of compressed air;

a manual play-participant-operated pump operated to pump a charge of compressed air into the air reservoir; and a valve interposed between the air reservoir and the launch tube, the valve being adapted when actuated to place one end of the launch tube in communication with the air reservoir; and a strobe light for selectively illuminating the launch tube whereby upon actuation of the valve, the charge of compressed air is delivered to the launch tube, propelling the projectile down the launch tube into the air.

26. The impact-safe projectile launch system of claim 18 wherein the impact-safe foam ball has a diameter of about 2½ inches, and a weight of about 0.15 oz. and is formed from an expanded ethylene vinyl acetate material having a density of about 2 lbs/ft$^3$.

27. An impact-safe projectile launcher for propelling projectiles, the projectile launcher comprising:

a nozzle adapted to receive a flow of compressed air, to accelerate the flow of compressed air to form a stream of high-velocity air, and to direct the stream of high-velocity air to impinge upon the projectile;

a play-participant-actuated valve interposed between the nozzle and a source of compressed air, the valve being adapted when actuated to place the nozzle in communication with the source of compressed air; and a swivel-mounted base for allowing rotation of the projectile launcher in vertical and horizontal planes;

whereby upon actuation of the valve, the nozzle discharges a stream of high-velocity air which transfers momentum to the projectile, propelling it in a desired direction.

28. The projectile launcher of claim 27 further comprising a launch tube sized to accommodate insertion of an impact-safe projectile with substantially little to no friction between the launch tube inner wall and the projectile.

29. The projectile launcher of claim 27 wherein the nozzle comprises an ejector exhaust muffler.

30. The projectile launcher of claim 27 in combination with an impact-safe foam ball having a diameter of about 2½ inches, and a weight of about 0.15 oz. and being formed from an expanded ethylene vinyl acetate material having a density of about 2 lbs/ft$^3$.

31. A projectile launcher for use by play participants comprising:

means for holding an impact-safe projectile in a position for launching;

means for providing a flow of compressed air;

means for accelerating the flow of compressed air to form a stream of high-velocity air;

means for selectively delivering the stream of high-velocity air to directly impact one side of the projectile and to transfer momentum to the projectile for accelerating the projectile;

play-participant-operated means for directing the accelerated projectile in a desired direction; and play-participant-operated means for controlling the stream delivering means and being adapted when actuated to cause the stream delivering means to deliver a stream of high-velocity air to accelerate the projectile.

32. The projectile launcher of claim 31 wherein the projectile holding means comprises a launch tube sized and configured to accommodate insertion of an impact-safe projectile.

33. The projectile launcher of claim 31 wherein the charge delivering means comprises a nozzle adapted to receive a flow of compressed air and to discharge the stream of high-velocity air directed at the projectile.

34. The projectile launcher of claim 31 wherein the charge delivering means comprises a nozzle adapted to receive a flow of compressed air and to discharge a stream of high-velocity air impinging upon the projectile.

35. The projectile launcher of claim 31 wherein the charge delivering means comprises a nozzle adapted to receive compressed air from a source and to deliver it to an expansion chamber disposed behind the projectile.

36. The projectile launcher of claim 31 wherein the projectile directing means comprises a launch tube.

37. A projectile launcher for use by play participants comprising:

means for holding an impact-safe projectile in a position for launching;

means for selectively delivering a charge of high-velocity air in a stream directly impacting one side of the projectile for accelerating the projectile;

play-participant-operated means for directing the accelerated projectile in a desired direction; and play-participant-operated means for controlling the charge delivering means and being adapted when actuated to cause the charge delivering means to deliver a charge of high-velocity air to accelerate the projectile wherein the projectile directing means comprises rails.

38. The projectile launcher of claim 31 wherein the controlling means comprises a play-participant-actuated solenoid valve.

39. The projectile launcher of claim 31 in combination with an impact-safe foam ball having a diameter of about 2½ inches, and a weight of about 0.15 oz. and being formed from an expanded ethylene vinyl acetate material having a density of about 2 lbs/ft$^3$.

40. A method for launching a projectile at a desired safe velocity comprising the steps of:

holding the projectile in a position for launching;

providing the flow of compressed air to a nozzle;

accelerating the flow of compressed air within the nozzle to form a stream of high-velocity air; and directing the stream of high-velocity air at the projectile so that the momentum of the stream of air is transferred to the projectile to accelerate the projectile in a desired direction; and regulating the velocity of said stream of air such that said projectile attains a desired safe velocity upon launching.

41. The projectile launcher of claim 1 wherein the velocity of the stream of air is controlled by controlling the pressure of the compressed air.

42. The projectile launcher of claim 27 whereby the velocity of the stream of air is controlled by controlling the pressure of the compressed air.

* * * * *